US011427007B2

(12) United States Patent
Lee et al.

(10) Patent No.: US 11,427,007 B2
(45) Date of Patent: Aug. 30, 2022

(54) INK STORAGE TANK OF INKJET PRINTER INCLUDING AGITATOR WITH IMPROVED DISPERSION STABILITY

(71) Applicant: GOSANTECH CO., LTD., Cheonan-si (KR)

(72) Inventors: Sung-Hee Lee, Cheonan-si (KR); Ji-Hee Boo, Cheonan-si (KR); So-hyeon Park, Cheonan-si (KR)

(73) Assignee: GOSANTECH CO., LTD., Cheonan-si (KR)

( * ) Notice: Subject to any disclaimer, the term of this patent is extended or adjusted under 35 U.S.C. 154(b) by 63 days.

(21) Appl. No.: 17/097,383

(22) Filed: Nov. 13, 2020

(65) Prior Publication Data

US 2022/0088936 A1 Mar. 24, 2022

(30) Foreign Application Priority Data

Sep. 21, 2020 (KR) ..... 10-2020-0121251

(51) Int. Cl.
*B41J 2/175* (2006.01)

(52) U.S. Cl.
CPC ..... *B41J 2/17513* (2013.01)

(58) Field of Classification Search
CPC ..... B41J 2/17513
USPC ..... 347/86
See application file for complete search history.

(56) References Cited

U.S. PATENT DOCUMENTS

2008/0101156 A1 5/2008 Yatomi et al.
2008/0165233 A1* 7/2008 Lin ..... B41J 2/17513 347/86
2017/0368831 A1* 12/2017 Komplin ..... B01F 31/56

FOREIGN PATENT DOCUMENTS

| | | | |
|---|---|---|---|
| JP | 7-786 | A | 1/1995 |
| JP | 2012-016823 | A | 1/2012 |
| JP | 2014-97616 | A | 5/2014 |
| KR | 10-2006-0070799 | A | 6/2006 |
| KR | 20-0445857 | Y1 | 9/2009 |
| KR | 10-1989375 | B1 | 6/2019 |
| KR | 10-2020-0070676 | A | 6/2020 |
| KR | 10-2020-0079378 | A | 7/2020 |

* cited by examiner

*Primary Examiner* — Kristal Feggins
*Assistant Examiner* — Alexander D Shenderov
(74) *Attorney, Agent, or Firm* — Sughrue Mion, PLLC

(57) ABSTRACT

Proposed is an ink storage tank that stores ink to supply the ink to an inkjet head equipped with a plurality of nozzles configured to eject the ink, the tank including an agitator configured to agitate the ink in an ink storage space defined in a housing of the ink storage tank, where the agitator includes a rotary shaft horizontally installed in the ink storage space, one or more blades that protrude outward from the rotary shaft, and a rotation drive unit configured to rotate the rotary shaft, and where the bottom surface of the ink storage space has a concavely curved shape corresponding to the trace of the outer edges of the rotating blades. The ink storage tank has an effect of maintaining desired dispersibility of particles in ink due to the agitator having the horizontal rotary shaft and the concavely curved bottom surface of the ink storage space.

8 Claims, 9 Drawing Sheets

INK STORAGE TANK OF INKJET PRINTER INCLUDING AGITATOR WITH IMPROVED DISPERSION STABILITY

CROSS REFERENCE TO RELATED APPLICATION

The present application claims priority to Korean Patent Application No. 10-2020-0121251, filed Sep. 21, 2020, the entire contents of which are incorporated herein for all purposes by this reference.

BACKGROUND OF THE INVENTION

1. Field of the Invention

The present disclosure relates to a storage tank for storing ink to supply the ink to an inkjet head used in an inkjet printer. More particularly, the present disclosure relates to an ink storage tank for an inkjet printer used in various industrial fields.

2. Description of the Related Art

In general, art inkjet printing method of ejecting liquid ink on a surface of a medium in the form of droplets in accordance with a shape signal is used not only for printing of documents and leaflets but also for solution processing in industrial fields of semiconductor or display.

An application range of inkjet printing which can form a complicated pattern on a substrate or accurately discharge ink on a specific position is wide. A small-sized inkjet printer for document writing has the form in which ink is stored in an inkjet head which discharges ink droplets, but a large document printer or an industrial-use inkjet printer uses a large amount of ink, and a structure in which an ink container and an inkjet head are separated from each other is applied thereto.

In order to discharge an exact amount of ink in the inkjet printing process, it is necessary to maintain the ink in a meniscus state in which the surface of the ink ready for ejection from the inkjet head has a concave shape due to capillary action with respect to a nozzle inlet. Accordingly, to prevent the ink from flowing down in the inkjet head to maintain the meniscus state thereof, it is typical to position an ink storage tank higher than that of the inkjet head and to generate a negative pressure inside the ink storage tank in the related art.

Meanwhile, as the fields to which the inkjet printer is applied have diversified recently, ink in which particles are dispersed has been widely used much like a case of using ink in which metal particles are dispersed for forming an electrode pattern. In particular, in the field of OLED displays, attempts are being made to apply particles such as a quantum dot material contained in ink to a predetermined pattern or to a predetermined position by a method of inkjet printing using ink in which the quantum dot material is dispersed. However, there is a problem of reduction of ink dispersibility that occurs when the metal particles or quantum dot materials sink in the ink container due to weight thereof while stored in the ink container, and the application of the inkjet printing has not actively proceeded.

A technology that circulates ink by returning the ink from the inkjet head to the ink container without supplying the ink in one direction toward the inkjet head thus maintaining desired dispersibility has been developed. However, the requirement for the maintaining of desired dispersibility of ink stored in an ink container is still an important issue. Thus, the technology to maintain desired dispersibility of the material contained in ink is required while the ink is stored in the ink container.

In the field of display devices, the use of a quantum dot (QD) material has been commercialized after the wide use of OLEDs, and an inkjet printing technology is being developed using ink in which the quantum dot material is dispersed in order to produce a large-area display device. During an inkjet printing process, the dispersibility of the quantum dot material contained in the ink needs to be maintained, and in some cases, an ink storage tank was installed with an agitator to maintain desired dispersibility of the quantum dot material while the quantum dot material is stored in the ink storage tank of the inkjet printer. However, since the ink storage tank of the inkjet printer needs to be remained at a negative pressure inside, the commonly used bar type agitator (Japanese Patent Application Publication No. 2012-016823) may not sufficiently agitate the ink while maintaining the negative pressure inside the ink storage tank.

Recently, with further development in a display device using quantum dot materials and organic light-emitting diodes (OLEDs), interest in a quantum dot nano LED (QNED) (or QD-inorganic LED) display is increasing. The QNED uses the quantum dot material for color conversion in the same manner as that described above. However, the QNED uses an inorganic LED instead of the OLED for the light-emitting device which emits light, which particularly applies the inorganic LED in the form of a nanorod. By applying the nano rod type of inorganic LED, the QNED can replicate the unique feature that may be only obtained from conventional OLED, and has the advantage of not causing a burn-in phenomenon that is the disadvantage of the OLED.

The nanorod used in the QNED is a nanosized material like a nanoparticle. The term "nanorod" is named because it has the shape of the large aspect ratio which is a ratio of height to diameter. Since the nanorod used in the manufacturing of the QNED is manufactured in a height range from hundreds of nanometers to micrometers, the nanorod is larger in size than the quantum dot material dispersed in the ink and is more difficult to maintain desired dispersibility compared to the quantum dot material which is currently applied in inkjet printing.

Since a conventional bar type agitator that rotates around a vertical rotary shaft does not work well for ink in which a quantum dot material is dispersed, it is more difficult for the conventional bar type agitator to maintain desired dispersibility when using ink that contains the nanorod that is larger in size than the quantum dot material.

Therefore, in order to apply inkjet printing in the fields of manufacturing of a display device, it is necessary to maintain desired dispersibility of a material such as the nanorod that is very low in ink.

DOCUMENTS OF RELATED ART

Patent Documents (Patent Document 1) Korean Patent No. 10-1989375

(Patent Document 2) Japanese Patent Application Publication No. 2012-016823

SUMMARY OF THE INVENTION

The present disclosure has been made in view of the problems occurring in the related art, and an objective of the present disclosure is to provide an ink storage tank for an inkjet printer, the tank being configured to maintain desired dispersibility of ink in which nanorods are dispersed.

In order to achieve the above object, according to one aspect of the present disclosure, there is provided an ink storage tank for an inkjet printer, the ink storage tank storing ink to supply the ink to an inkjet head equipped with a plurality of nozzles configured to eject the ink, the tank including: an agitator mixing the ink in an ink storage space defined in a housing of the ink storage tank; where the agitator includes a rotary shaft horizontally installed in the ink storage space, one or more blades that protrude outward from the rotary shaft, and a rotation drive unit configured to rotate the rotary shaft, and where a bottom surface of the ink storage space has a concavely curved shape corresponding to a trace of outer edges of each of the rotating blades.

The ink storage tank of the present disclosure may have an excellent effect to maintain the desired dispersibility of nanorods in ink in which the nanorods required for QNED manufacturing are dispersed. The QNED is the same as the current QD-OLED in using a quantum dot material for color conversion, however, the QNED has a feature that uses an inorganic LED in the form of the nanorod as a light-emitting device. In the QNED, accurate positioning of the nanorods in one pixel by a predetermined amount is important, and applying of the inkjet printing to the process of positioning the nanorods may greatly increase production efficiency. However, since the nanorod that has a height range from hundreds of nanometers to micrometers and a large aspect ratio needs to be maintained evenly dispersed in ink to ensure accurate inkjet printing, a technology that may maintain desired dispersibility of the nanorod is required.

The present disclosure may provide a new structure of an ink storage tank that can enhance agitating effect compared to a conventional bar type agitator with a vertically positioned rotary shaft. The present disclosure has an effect of maintaining sufficient dispersibility of nanorods in ink due to the specific bottom surface structure of the ink storage tank and the agitator having the horizontal rotary shaft.

It is preferred that the rotation drive unit is disposed outside the housing of the ink storage tank, and where a rotational force of the rotation drive unit disposed outside the housing rotates the rotary shaft disposed inside the housing, the rotational force being caused by a magnetic force that arises between a first magnetic element that is connected to the rotary shaft and disposed inside the housing and a second magnetic element that is connected to the rotation drive unit and disposed outside the housing.

For easy management, the rotation drive unit to rotate the agitator may need to be installed outside the housing. The present disclosure may use a magnetic force rather than a structure of passing through the housing to transmit the rotational force of the rotation drive unit disposed outside the housing to the rotary shaft disposed inside the housing. The rotational force of the rotation drive unit may be transmitted correctly by configuring the first magnetic element which includes four magnetic poles arranged in a manner that N poles and S poles alternate, and the second magnetic element which includes four magnetic poles positioned such that the poles correspond to the four magnetic poles of the first magnetic element, respectively, and arranged in a manner that N poles and S poles alternate.

It is preferred that each of the one or more blades is provided with a plurality of through-holes, and the through-holes may vary in diameter such that the through-hole relatively closer to the rotary shaft has a relatively smaller diameter and the through-hole relatively far from the rotary shaft has a relatively larger diameter.

The outer edge of each of the blades may be chamfered or sloped, and it is preferred that the blade is formed of a flexible material such as rubber.

The housing may be provided with a discharge port connected to a supply pipe through which the ink is supplied to the inkjet head, and it is preferred that the discharge port is positioned higher than the lowest position of the concavely curved bottom surface of the ink storage space by a predetermined height.

It is preferred that the ink storage tank may further include a sensor installed at the supply pipe through which the ink is supplied to the inkjet head, the sensor being configured to measure an amount of nanorods dispersed in the ink, and a controller that controls the rotation speed of the agitator on the basis of a measurement result of the sensor.

A partition may be installed in the housing to divide an internal space of the housing. The partition may be positioned at a height at which the partition is in contact with a surface of the ink and the partition does not interfere with the motion of the blades, and it is preferred that the partition divides the internal space of the housing in a grid form when viewed from above.

The ink storage tank of the present disclosure configured as described above has an effect of maintaining sufficient dispersibility of particles in the ink due to the agitator having the horizontal rotary shaft and the concavely formed bottom surface that is configured corresponding to the rotation of the agitator.

In particular, the ink storage tank of the present disclosure maintains the desired dispersibility of the nanorods in the ink and solves the problem of lowering dispersibility of nanorods in the ink due to the physical characteristics of the nanorods, thereby providing an excellent effect of realizing desired precision of the inkjet printing process using the ink containing the nanorods used in the manufacturing of the QNED.

In addition, by controlling the rotation of the agitator on the basis of the dispersed state of the nanorods in the ink, the ink may be agitated to an extent necessary to maintain the desired dispersibility of the nanorods, and the excessive flow of the ink is prevented and the energy waste caused by the excessive operation of the agitator is reduced.

DESCRIPTION OF THE PREFERRED EMBODIMENTS

Figure 1:
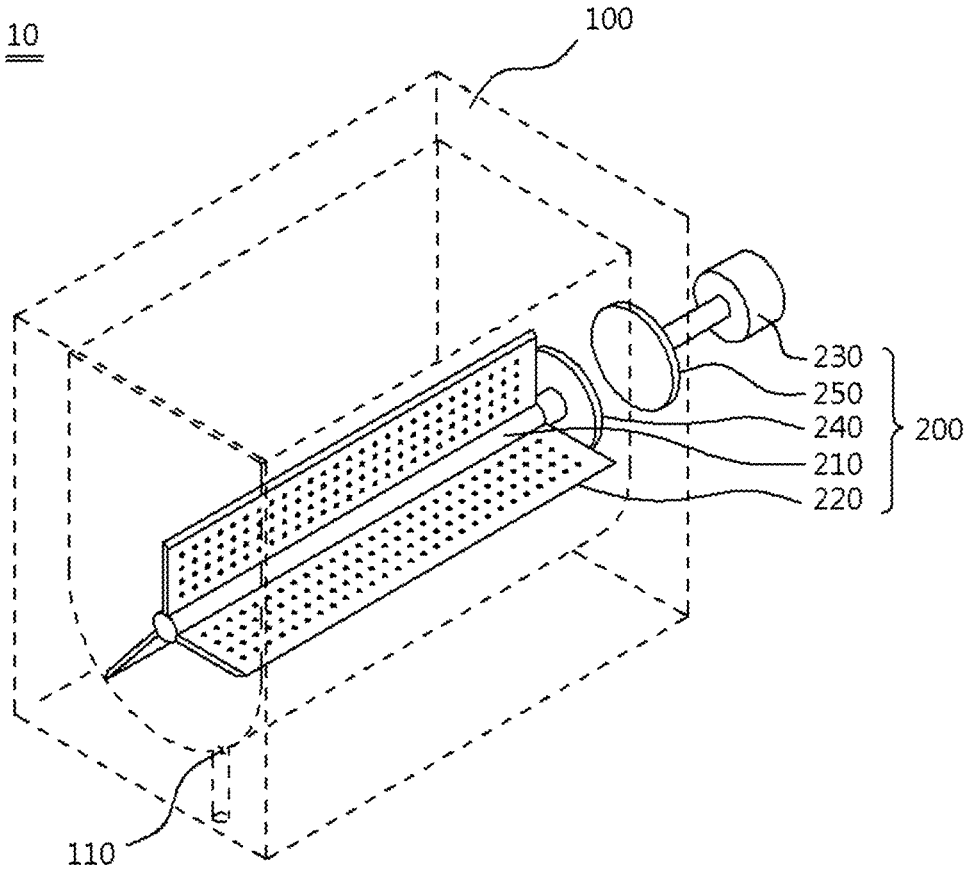
FIG. 1 is a diagram illustrating the construction of an ink storage tank according to an embodiment of the present disclosure.

Referring to the accompanying drawings, an embodiment according to the present disclosure will be described in detail.

However, the embodiment of the present disclosure can be modified into various other forms, and the scope of the present disclosure is not limited to the embodiment described below. The shape, the size, or the like of the elements in the drawings may be exaggerated for clearer explanation and the same elements are denoted by the same reference numerals in the drawings.

In addition, throughout the specification, when a part is referred to as being "connected" to another part, it includes not only in a case of being "directly connected" but also in a case of being "electrically connected" with another part therebetween. In addition, when a part is referred to as being "including" or "having" a component, it is to be understood that this does not exclude other components unless specifically stated otherwise, but may further include or has other components.

In addition, the terms "first", "second", and the like are used to distinguish one component from another component and the scope of the right should not be limited by these terms. For example, the first component may be referred to as a second component, and similarly, the second component may also be referred to as a first component.

FIG. 1 is a diagram illustrating the construction of an ink storage tank according to an embodiment of the present disclosure.

The ink storage tank 10 of the embodiment includes a housing 100 and an agitator 200.

The housing 100 is a casing in which an ink storage space is formed. The ink storage space is for storing ink therein. Although not shown, a pressure regulator to maintain a meniscus state by controlling the internal pressure of the ink storage space may be connected to the ink storage space. The ink storage space may be sealed to control the internal pressure except for the portion connected with the pressure regulator.

The pressure regulator controls the internal pressure of the ink storage tank very precisely to increase an accuracy of inkjet printing. The pressure regulator may be formed of only a negative pressure generator which generates a negative pressure to maintain the meniscus state. However, it is preferred that a positive pressure generator which generates a positive pressure is provided in the pressure regulator together with the negative pressure generator. The positive pressure generator may assist the pressure regulator to precisely control the pressure or may perform the operation of applying the positive pressure to the ink storage tank for the purpose of managing the inkjet printer and so on.

Since the pressure control by the pressure regulator is performed very precisely, care must be taken to ensure that movement of ink does not affect the internal pressure of the ink storage tank. This is due to the fact that when the ink moves excessively during a process of newly injecting ink or circulating ink, the internal pressure of the ink storage tank may fluctuate, and this makes precise control of the pressure regulator difficult.

For this reason, maintaining the airtightness of the ink storage tank is very important, and when the airtightness of the ink storage tank is not maintained, the precision of control by the pressure regulator may be reduced.

The agitator 200 mixes ink stored in the ink storage space formed inside the housing 100 to maintain desired dispersibility of a dispersed material such as nanorods contained in the ink.

A commonly used agitator has a structure that rotates on the basis of a vertical rotary shaft on a bottom of the ink storage space. These common agitators were sufficiently functioned for maintaining the uniformity of ink itself but were not sufficiently functioned to maintain desired dispersibility of particles when metal particles or quantum dot materials were dispersed. Therefore, these common agitators cannot be used to maintain the desired dispersibility of the nanorods with less dispersibility. The nanorod referred to hereinafter refers to a nanorod used as a light-emitting element during a manufacturing process of a QNED display device. In general, a GaN nanorod is known as a nanorod for the QNED display device, but not limited thereto, not only a nanorod of currently being developed materials but also various materials of a nanorod which will be researched from now on may be applied. In addition, a size of a nanorod is not limited to a size of a nanorod for the currently developed QNED display device, but may be applied to all the various sizes of the nanorod that will be researched from now on.

The agitator 200 of the embodiment includes a horizontal rotary shaft 210 and one or more blades 220 that protrude outward from the rotary shaft 210, and the agitator 200 operates in a manner that when the blade 220 rotates, the ink at the bottom is pulled up. It is preferred that these blades 220 are configured of two or more plural numbers, and positioning the outer end of the blade to close to the bottom surface of the ink storage space may increase efficiency in a motion of pulling the ink upward.

By configuring the bottom surface of the ink storage space to have a concavely curved shape corresponding to a trace of the outer edge of each of the rotating blades 220, ink agitating efficiency due to the rotation of the blades 220 may be further increased.

Since particles dispersed in ink, especially the nanorods, are sink to the bottom of the ink by their own weight, applying the agitator 200 such as in the embodiment allows the sunken nanorod to move upward in the ink storage space to maintain desired dispersibility thereof.

Although not shown in FIG. 1, it is preferred that the blades 220 of the agitator 200 are configured such that entire portion thereof is submerged in the ink. This is because the rotation of the blades 220 may cause a problem that outside air above the ink to inflow into the ink when the blades 220 are exposed above the surface of the ink during a rotation of the blades 220.

In this way, by moving the blades 220 in a direction different from that of the conventional agitator and forming a bottom surface of the ink storage space to have a shape corresponding to a trace of the outer edge of each of the rotating blades 220, it is possible to maintain desired dispersibility of not only the ink in which metal particles or quantum dot materials are dispersed but also the ink in which the nanorods are dispersed.

In addition, the agitator 200 in the embodiment is not attached to one side of the ink storage space but is formed so that the rotary shaft 210 crosses almost the entire ink storage space. Therefore, the blades 220 may be formed along the total length of the rotary shaft 210 so that the ink is efficiently pulled up over the entire bottom surface of the ink storage space. The shape of the blades 220 is not limited to the long plate shape as it is shown in the drawings, but may be changed, and it may also be a bent wavy screw shape formed around the rotary shaft 210. In particular, since the maintenance of the meniscus state is difficult when the rotation of the blades causes the ink to move excessively, it is preferred that the blades are configured to avoid the excessive flow of the ink while maintaining the effectiveness of pulling the ink upward. For example, the blades 220 may have a curved shape rather than a straight-line shape, and multiple blades having a space therebetween may be applied instead of one longitudinal blade extending in the lengthwise direction.

Figure 2:
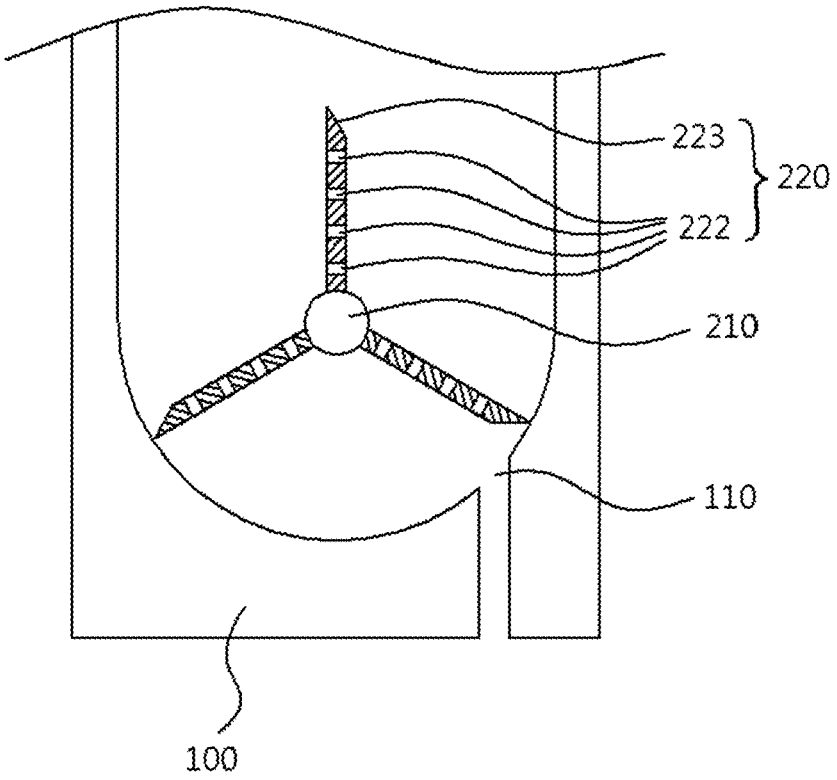
FIG. 2 is a cross-sectional view illustrating the construction of blades in an agitator according to an embodiment of the present disclosure.
Figure 3:
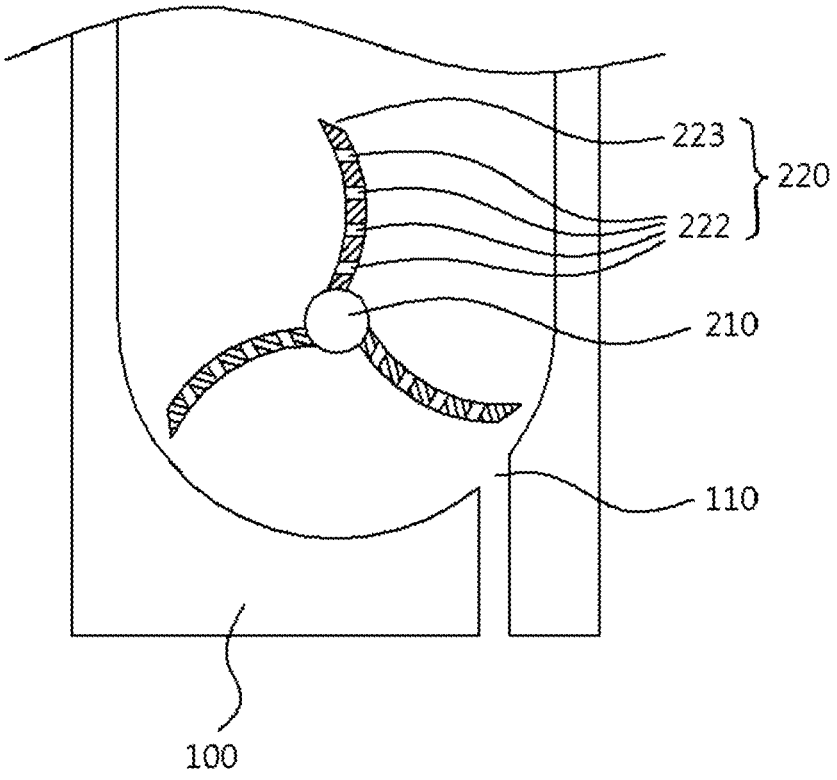
FIG. 3 is a cross-sectional view illustrating the construction of blades according to another embodiment of the present disclosure.
Figure 4:
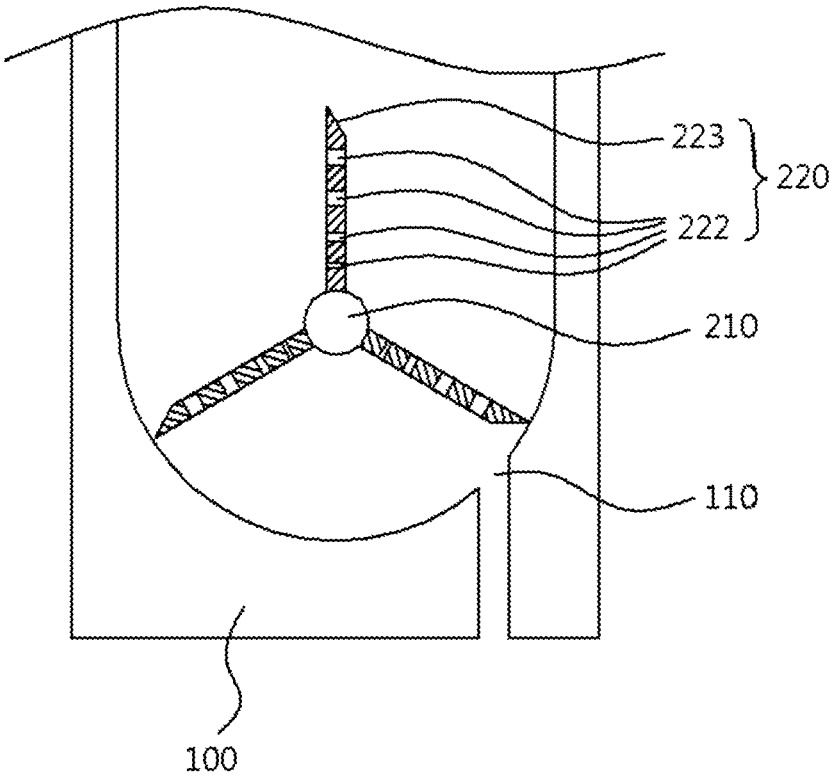
FIG. 4 is a cross-sectional view illustrating the construction of blades according to still another embodiment of the present disclosure.

FIG. 2 is a cross-sectional view illustrating the construction of blades in the agitator according to an embodiment of the present disclosure, FIG. 3 is a cross-sectional view illustrating the construction of blades according to another embodiment of the present disclosure, and FIG. 4 is a cross-sectional view illustrating the construction of blades according to still another embodiment of the present disclosure.

As described above, the blades 220 used in the agitator 200 of the present disclosure may have a plate structure with a straight-line shape as illustrated in FIG. 2 or a plate structure with a curved cross-section as illustrated in FIG. 3. In the curved cross-section as illustrated in FIG. 3, the blades 220 may not have a straight-line shape, but may form a bent wavy screw shape around the rotary shaft 210. The cross-sectional shape of the blades may vary, and the length of each of the blades 220 from the rotary shaft 210 to the outer edges thereof may not be uniform. Further various shapes of the blades 220 may be provided to maintain the effect of pulling up the dispersed materials such as the nanorods in the ink by the rotation of the blades 220 that rotate by the horizontal rotary shaft 210, without interfering with the precise control of internal pressure to keep the meniscus state from the excessive flow of the ink.

In the embodiment, a plurality of through-holes 222 are formed on the blades 220 to prevent excessive flow of the ink during the rotation of the blades 220, while removing air bubbles inside the ink at the same time. The through-holes 222 are formed so that the ink may pass therethrough during the rotating process of the blades 220, which reduce the overall flow of the ink caused by the rotation of the blades 220. Thus, the effect of maintaining the desired dispersibility by moving the sunken nanorods at the bottom of the ink storage space to the top of the ink storage space is achievable. As described above, for applying inkjet printing, the internal pressure of the ink storage tank needs to be controlled so that the inkjet head can maintain the meniscus state. Since the precision of the inkjet printing increases when the internal pressure of the ink storage tank is controlled more precisely, precisely controlling the internal pressure of the ink storage tank is required to apply the inkjet printing to ultra-precision fields such as a display device manufacturing. However, since the excessive flow of ink causes a reduction in the precision of controlling the internal pressure, minimizing an effect of the flow of the ink during a process of maintaining the desired dispersibility by an agitator is required. In the embodiment, in order to minimize the effect of the flow of the ink on the internal pressure control of the ink storage tank 10, the through-holes 222 are formed on the blades 220.

In addition, in the embodiment, the through-holes 222 formed on the blades 220 may be used to remove micro bubbles in the ink. Here, the micro bubbles may be generated in the ink during a process of injecting or circulating of ink.

Furthermore, as illustrated in FIG. 4, by differently sizing the through-holes 222 formed on the blades 220, it is possible to prevent the excessive flow of the ink more effectively. The impact of the rotation of the blades 220 on the ink is stronger at the ends of the blades 220, which becomes stronger as the through-holes are distant from the rotary shaft 210. Therefore, by configuring the diameters of the through-holes 222 vary relative to the distance from the rotary shaft 210, excessive flow of the ink may be more effectively prevented. In the embodiment, the through-holes 222 arranged in several different columns on the rotary shaft 210 have different diameters according to the positions thereof. In other words, the diameters of the through-holes 222 located close to the rotary shaft 210 are relatively smaller than the diameters of the through-holes 222 located away from the rotary shaft 210 so that the diameters of the through-holes 222 become larger in proportion to the distances from the rotary shaft 210.

In the illustrated embodiment, the through-holes 222 are arranged along four columns, and the sizes of the through-holes 222 vary sequentially according to the positions of the four columns, but not limited thereto. A method of configuring the positions at which the through-holes 222 are arranged and sizing the diameters of the through-holes 222 differently may be variously realized if the through-holes 222 relatively closer to the rotary shaft 210 have relatively smaller diameters and the through-holes 222 relatively far from the rotary shaft 210 have relatively larger diameters.

In addition, by configuring the outer edges of each of the blades 220 chamfered or sloped as shown by numeral 223 in drawings, the excessive flow of the ink caused by the rotation of the blades 220 may be prevented. The material of the blades 220 may be a flexible material such as rubber. When the blades 220 are made of a flexible material, it is possible to reduce the problem of friction even if the outer edges of the rotating blades 220 are in a contact state with the bottom surface of the ink storage space.

For easy management, a rotation drive unit 230 to rotate the rotary shaft 210 with the blades 220 are attached needs to be positioned outside the housing 100. However, for a connection of the rotary shaft 210 and the rotation drive unit 230 positioned outside the housing 100, applying the structure which passes through the housing 100 causes various problems. Since the embodiment configures the rotary shaft 210 of the agitator 200 and the blades 220 both to position in the ink with a submerged state, the passed through area contacts the ink when the rotary shaft 210 is positioned with passing through the housing 100, so that it is difficult to prevent the ink from leaking while rotating.

Applying a structure that passes through the housing 100 causes a problem that is difficult to maintain the airtightness of the ink storage tank 10. In order to apply the inkjet printing to the manufacturing process of a display device, the precision of the inkjet printing needs to be high. For this, the internal control for maintaining the meniscus state of the inkjet printing needs to be performed with very precisely. Since the control for maintaining the meniscus state is performed toy the pressure regulator connected to the ink storage tank by controlling the internal pressure of the ink storage tank, the lower the airtightness of the ink storage tank results in lowering the precision of the inkjet printing. When the structure that passes through the housing 100 to rotate the rotary shaft 210 positioned inside the housing 100 is applied, it is expected that the housing 100 will lose the airtightness thereof, so a different structure is required to maintain the airtightness thereof.

Accordingly, in the embodiment, a method of magnetically connecting the rotary shaft 210 positioned inside the housing 100 and the rotation drive unit 230 positioned outside housing 100 is applied.

A first magnetic element 240 is connected to the rotary shaft 210 and disposed inside the housing 100, and connected to a second magnetic element 250 by a magnetic force with a wall of the housing 100 in between. The second magnetic element 250 is connected to the rotation drive unit 230 and disposed outside the housing 100. When a rotational force is generated from the rotation drive unit 230, then the second magnetic element 250 rotates, then the first magnetic element 240 rotates affected by the rotation of the second magnetic element 250, then the rotary shaft 210 connected to the first magnetic element 240 rotates by the rotation of the first magnetic element 240.

At this time, since both the first magnetic element 240 and the second magnetic element 250 are the configuration provided to transmit the rotational force of the rotation drive unit 230, so fixation and transmission of force at the correct position is required, and installing a plurality of magnetic poles on each of the first magnetic element 240 and the second magnetic element 250 is preferable.

Figure 5:
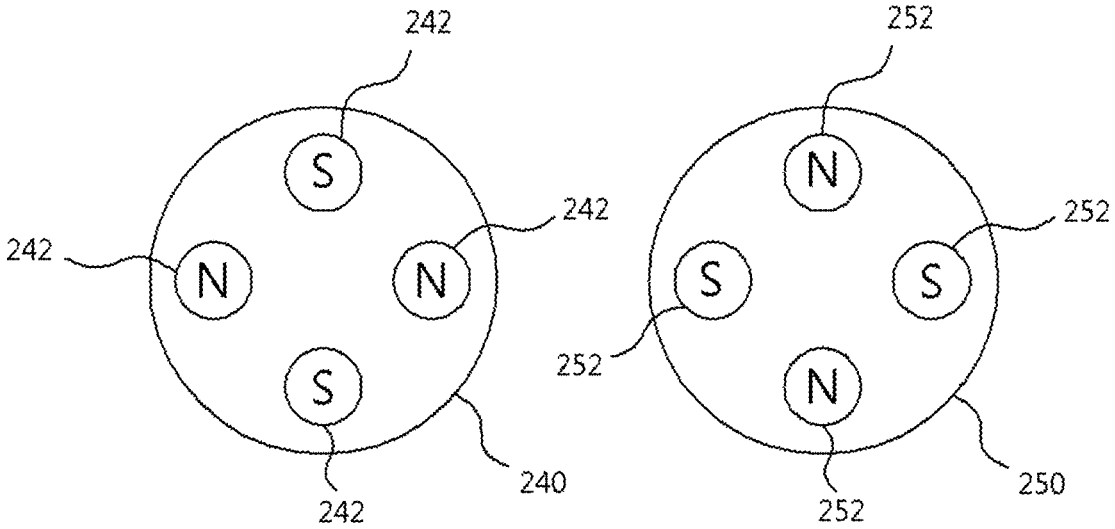
FIG. 5 is a diagram illustrating the arrangement of magnetic poles on a magnetic element in an agitator according to an embodiment of the present disclosure.

As illustrated in FIG. 5, in the embodiment, four magnetic poles were installed at each of the first magnetic element 240 and the second magnetic element 250. As illustrated, magnetic poles 242, 252 are arranged on a circular plate in four places arranged with a+ character in a manner that N poles and S poles alternate have been arranged, so that a position of the first magnetic element 240 and the second magnetic element 250 are fixed to each other, and the rotational force of the rotation drive unit 230 may be correctly transmitted to the rotary shaft 210. A layout of the magnetic poles which is for transmitting the rotational force and fixing a position of the first magnetic element 240 and the second magnetic element 250 is not limited as illustrated, and the layout of the magnetic poles may be changeable and adding another magnetic pole may be possible.

In the embodiment, since the magnetic force is used to fix and rotate the rotary shaft 210, the position of the rotary shaft 210 is difficult to completely fix and the radius of rotation of the blades 220 may be slightly changed. As described above, the blades 220 contacting the bottom surface of the housing may not cause problem since the blades 220 are formed of a flexible material such as rubber.

On the other hand, the housing 100 is formed with a discharge port 110 that connects a supply pipe 400 to the ink storage space to supply ink to the inkjet head. By configuring the bottom surface formed in the housing 100 of the ink storage tank 10 of the embodiment to have a concavely curved shape corresponding to a trace of the outer edges of each of the rotating blades 220, the installation position of the discharge port 100 is different from a general position thereof. The discharge port 110 for discharging the ink is formed generally on the bottom with the lowest height in the ink storage space; however, in the embodiment, the discharge port 110 is formed at a predetermined height above the lowest height of the curved shape bottom surface. This prevents the nanorod sunken to the bottom surface from being discharged before which being mixed by the agitator 200.

Figure 6:
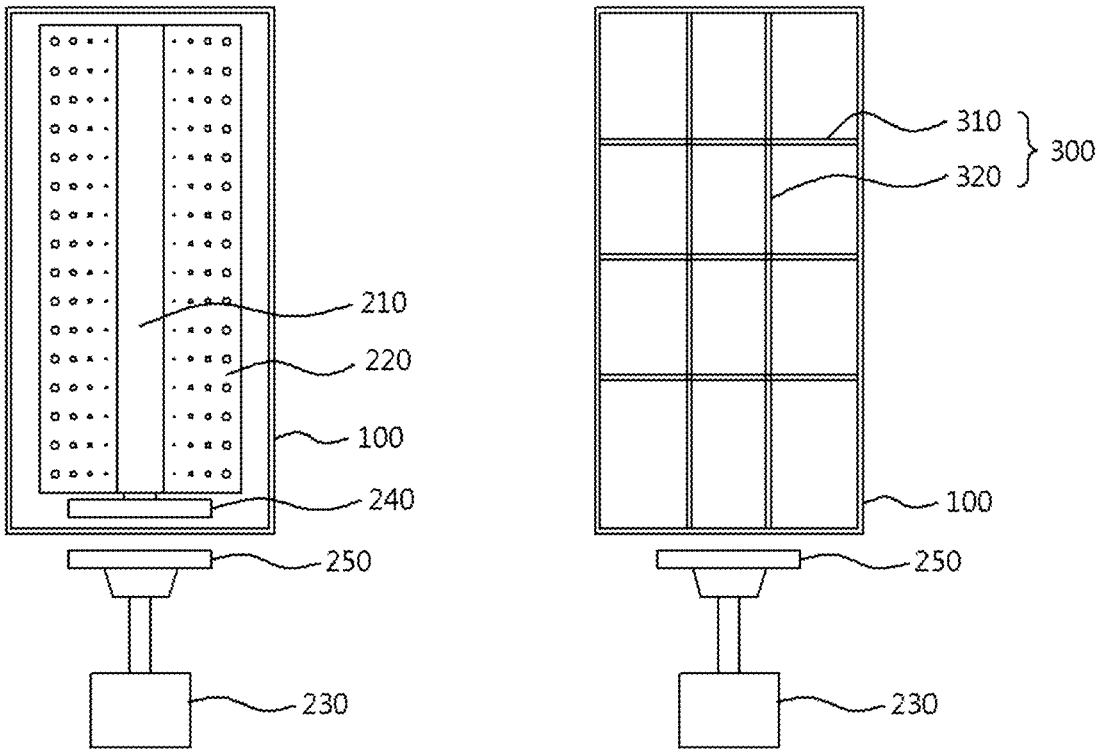
FIG. 6 is a sectional plan view illustrating the configuration of an ink storage tank according to an embodiment of the present disclosure.

FIG. 6 is a sectional plan view illustrating the configuration of an ink storage tank according to an embodiment of the present disclosure.

The left side illustration in FIG. 6 is a sectional plan view of the agitator 200 when viewed from a position where the rotary shaft 210 is installed. The right side illustration in FIG. 6 is a sectional plan view of the agitator 200 when viewed from above the radius of rotation of the blade 220.

The first magnetic element 240 connected to the rotation drive unit 230 and the second magnetic element 250 connected to the rotary shaft 210 are positioned on the outside and inside of the housing 100 in a corresponding position. The blade 220 that protrudes outward from the rotary shaft 210 has a plurality of through-holes 222.

A partition 300 horizontally dividing the internal space of the housing 100 is installed at above a rotating radius of the blades 220 without interfering with the motion of the blades 220. The partition 300 is installed at an upper portion of the ink storage space at a height at which the partition is in contact with a surface of the ink. This partition 300 has an effect of preventing the excessive flow on the surface of the ink.

The flow of the ink in the ink storage tank 10 occurs during the discharge and inflow of the ink. Since the excessive flow of the ink causes a problem in the process of maintaining the meniscus state, the flow of the ink caused by discharge and inflow of the ink is controlled so that the flow of the ink to be not large. However, in the process of repeatedly discharging and inflowing the ink, small flows are gradually accumulated and the excessive flow is generated on the surface of the ink. Excessive moving of the surface of the ink causes a problem to the pressure regulator which controls the internal pressure of the ink storage tank. This problem results in a reduction in the precision of the printing of the inkjet printer.

In order to solve the problem of accumulating ink flow within the ink storage space, the ink storage space of the present disclosure has the partition 300 inside the ink storage space to divide the space where the ink is stored to prevent excessive flow from the ink surface.

In installing the partition 300, it is important to install a first partition 300 across the space between the discharge port and the inflow port, since the main reason for installing a partition is about a discharge and an inflow of the ink conventionally. However, in the embodiment, since another flow of the ink is generated during the rotation of the blades 220 that agitating the ink at the bottom of the ink storage space, a second partition 300 installed across the space in the width direction of the ink storage space is used together. In this way, the problem caused by the accumulation of the flow of the ink may be prevented by installing the partition 300 that divides the internal space of the housing in a grid form that is observed when viewed from above.

Furthermore, the effect of removing micro bubbles may be obtained by installing the partition 300, and the effect of removing micro bubbles may be improved when the partition 300 is to be formed of fine air gap shape or mesh shape.

Figure 7:
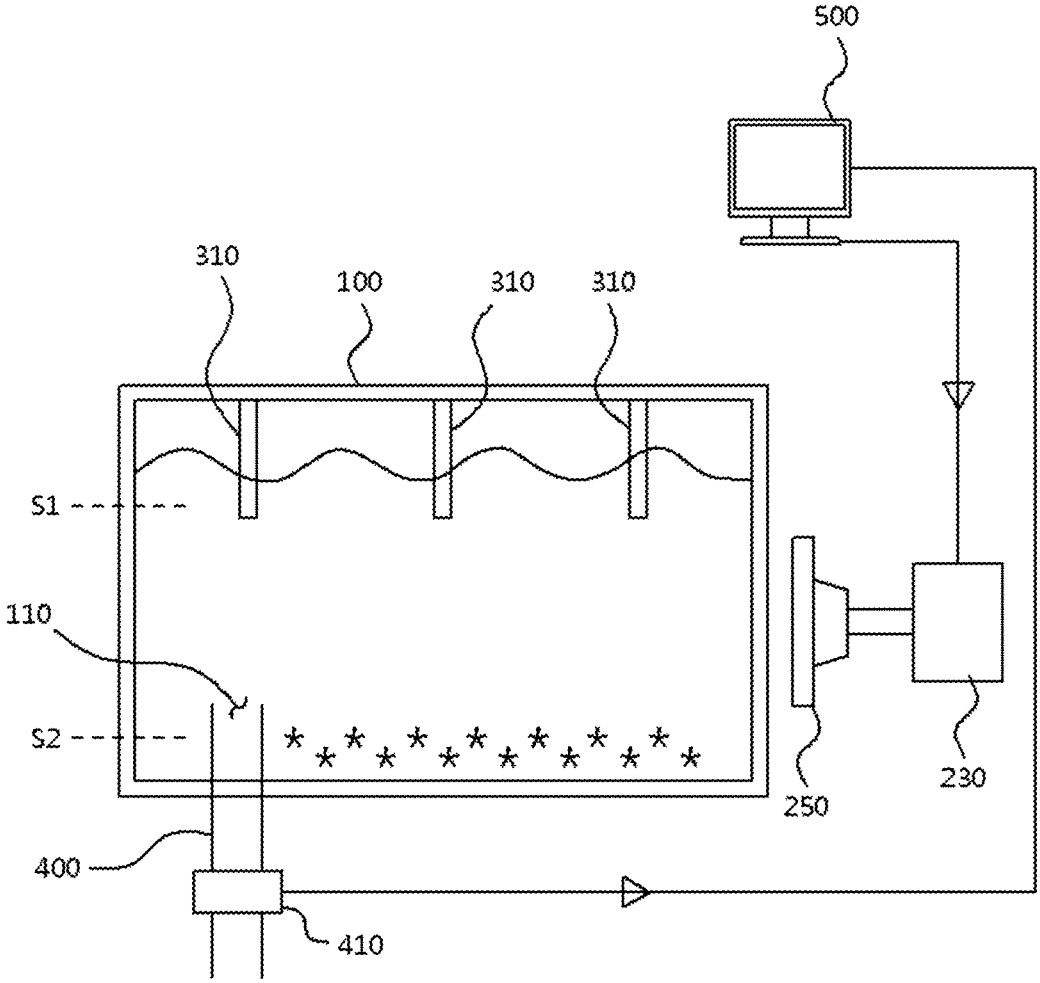
FIGS. 7 and 8 are views illustrating the configuration for controlling the operation of an agitator in an ink storage tank according to an embodiment of the present disclosure.
Figure 8:
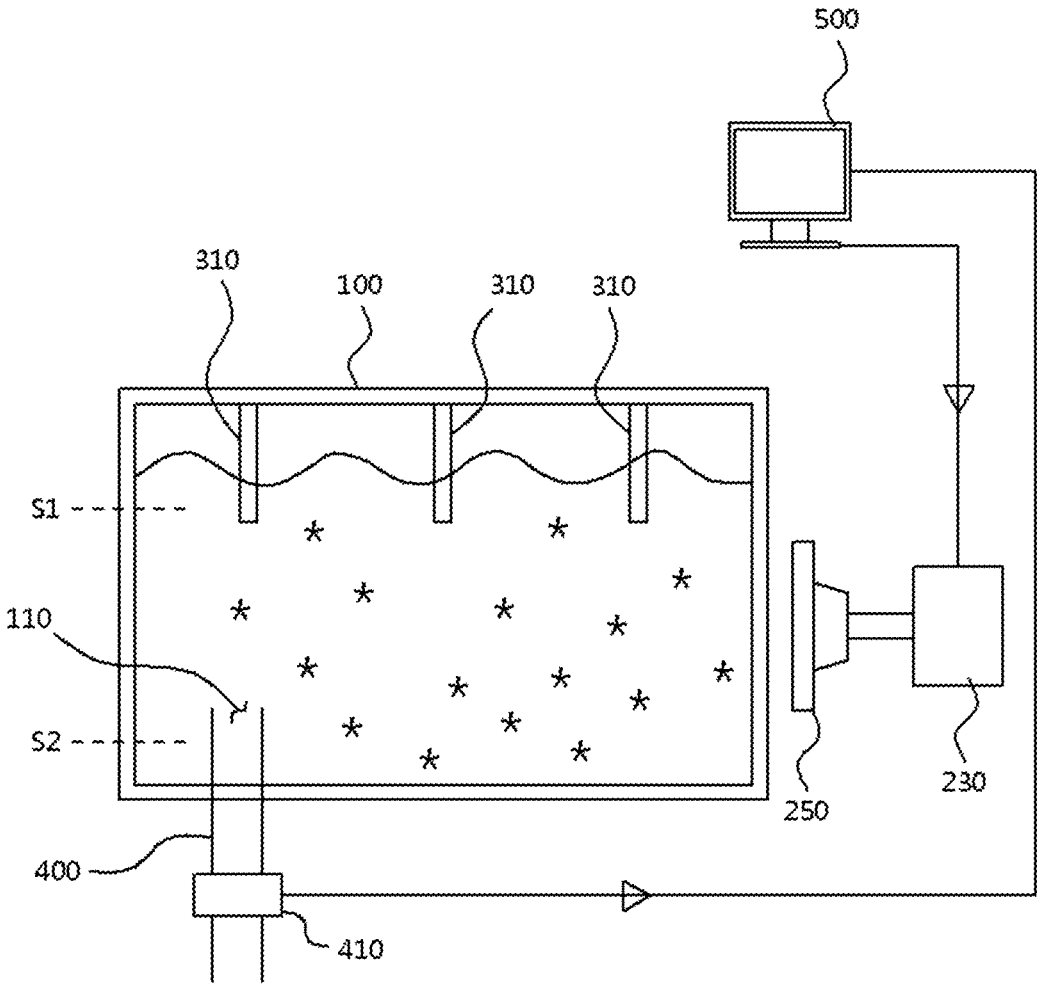

FIGS. 7 and 8 are views illustrating the configuration for controlling an operation of an agitator in an ink storage tank according to an embodiment of the present disclosure.

The ink storage tank 10 in the embodiment further includes a sensor 410 installed at the supply pipe 400, and a controller 500 that controls the rotation drive unit 230 on the basis of a measurement result of the sensor 410. Hereinafter, the nanorods will be described as an example of the dispersed material, but not limited thereto, and the same or similar method may be applied to a dispersed material such as the quantum dot material. In addition, as explained before, in the embodiment, the blades 220 of the agitator 200 operate in a state in which all portion of the blades 220 are submerged in the ink.

When the dispersibility of the nanorods dispersed in the ink is reduced, the nanorods are distributed more at a lower portion than an upper portion of the ink by the weight of the nanorods, as shown in FIG. 7. In this way, when a layer is formed due to the reduced dispersibility of the nanorods, the upper portion of the layer is marked as S1, and the lower portion where the nanorods are sunken is marked as S2. In this state, when the supply of the ink to the inkjet head continues, the ink containing the nanorods by an amount less than the target amount is printed at the beginning of the printing operation and this may reduce the quality of the printed product. This problem may be overcome by sufficiently agitating the ink using the agitator 200 of the present disclosure. However, unnecessary continuous operating the agitator 200 may cause other problems such as the excessive flow of ink and the waste of energy.

Therefore, when the nanorods in the ink are sufficiently dispersed, as shown in FIG. 8, the rotation drive unit 230 may be temporarily stopped or controlled to be slowly operated. However, when the dispersibility of the nanorods in the ink is reduced, as shown in FIG. 7, the rotation drive unit 230 may be controlled to be operated more powerfully.

To this end, the sensor 410 may be installed at the supply pipe 400 connected to a discharge port 110 of the housing 100. The sensor 410 is configured to detect the degree of dispersion of the nanorods by detecting the amount of the nanorods in the ink passing the supply pipe 400. In addition, the sensor 410 may detect the degree of dispersion of the nanorods passing the supply pipe 400 and transmits the detected result to the controller 500, and at the sane time, the sensor 410 may be configured to have an indication device such as an alarm which can indicate precipitation of the nanorods occurring in the ink due to the reduced dispersibility of the nanorods.

More particularly, when the dispersibility of the nanorods in the ink is reduced, the amount of nanorods passing to the supply pipe 400 connected to the inkjet head may be less than an adequate amount. When the amount of the nanorods detected by the sensor 410 is less than a predetermined value, the controller 500 may increase the rpm of the rotation drive unit 230 to more powerfully agitate the ink.

When the sensor 410 detects that the nanorods in the ink are sufficiently dispersed and the amount of nanorods that passes the supply pipe 400 is adequate, the controller 500 controls the rotation drive unit 230 to rotate at the initial rotation speed.

In addition, the controller 500 may set a standard of controlling the rotation drive unit 230 in advance. Alternatively, the average value of the distribution of the nanorods in the ink inside the ink storage space may be applied to the standard of control. In this case, it is possible to realize an advantage in that the standard may be applied to another ink which has different dispersibility of a dispersed material without changing the setting value. Specifically, the average value of the amount of the nanorods included in the S1 area and the S2 area divided on the basis of the case that the ink is divided into layers may be set as a standard value SV which represents a uniformly dispersed state. In addition, the output value that operates the rotation drive unit 230 may be set by comparing the process value PV which is the amount of the nanorods measured by the sensor 410 with the standard value SV. The final output value V controlled by the controller 500 for the initial output value $V_0$ of the rotation drive unit 230 is represented by the following equation 1.

$$V=V_0\pm V_c \text{ (where } V\leq V_{max}) \quad \text{[Equation 1]}$$

wherein $V_c$ is controlled on the basis of the result detected by the sensor and is represented by the following equation 2.

$$V_c=|((PV-SV)/SV)\times V_{max}| \quad \text{[Equation 2]}$$

wherein $V_{max}$ is the maximum output value of the rotation drive unit 230.

Figure 9:
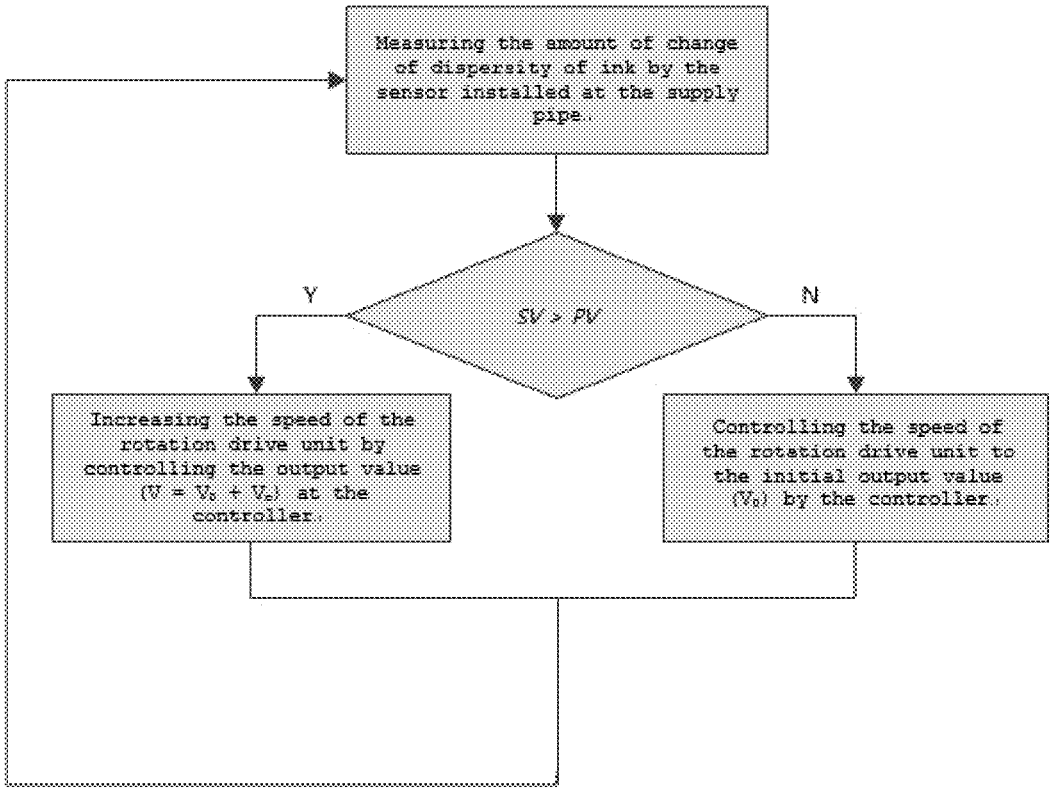
FIG. 9 is a flowchart illustrating the process of controlling a rotation drive unit in an ink storage tank according to an embodiment of the present disclosure.

FIG. 9 is a flowchart to explain the process of controlling a rotation drive unit in the ink storage tank according to an embodiment of the present disclosure.

In this way, by controlling the operation of the rotation drive unit 230 on the basis of dispersed amount of the nanorods measured in the supply pipe 400, the excessive flow of the ink may be prevented while maintaining the desired dispersibility of the nanorods in the ink. In addition, there is an effect of maintaining the precision of the internal pressure control of the ink storage tank, and of maintaining the desired printing precision of the inkjet printer. Furthermore, excessive consumption of energy due to an unnecessary operation of the rotation drive unit 230 may be prevented.

The ink storage tank 10 of the present disclosure, unlike the conventional agitator, may efficiently mix the ink in the bottom of the ink storage space in the form of pulling the ink upward, so the effect of maintaining the desired dispersibility of materials dispersed in the ink is improved. Therefore, although it is noted that the nanorods for the QNED have a lower dispersibility than the material conventionally dispersed in the ink, it is possible to maintain sufficient dispersibility of the nanorods even for the ink in which the nanorods for the QNED are dispersed.

Furthermore, by controlling the rotation of the agitator on the basis of the dispersed state of the nanorods in the ink, it is possible to prevent excessive flow of ink by efficiently agitating the ink to an extent necessary to maintain the desired dispersibility of the nanorods.

What is claimed is:

1. An ink storage tank for an inkjet printer, the tank storing ink to supply the ink to an inkjet head equipped with a plurality of nozzles configured to eject the ink, the tank comprising:

an agitator mixing the ink in an ink storage space defined in a housing of the ink storage tank;

wherein the agitator includes a rotary shaft horizontally installed in the ink storage space, one or more blades that protrude outward from the rotary shaft, and a rotation drive unit configured to rotate the rotary shaft, wherein a bottom surface of the ink storage space has a concavely curved shape corresponding to a trace of outer edges of the rotating blades, wherein the housing is provided with a discharge port connected to a supply pipe through which the ink is supplied to the inkjet head, and wherein the discharge port is positioned higher than the lowest position of the concavely curved bottom surface of the ink storage space by a predetermined height.

2. The tank according to claim 1, wherein each of the one or more blades is provided with a plurality of through-holes.

3. The tank according to claim 2, wherein the through-holes vary in diameter such that a through-hole relatively closer to the rotary shaft has a relatively smaller diameter and a through-hole relatively far from the rotary shaft has a relatively larger diameter.

4. The tank according to claim 1, wherein the outer edges of each of the blades is chamfered or sloped.

5. The tank according to claim 1, further comprising:

a partition installed in the housing to divide an internal space of the housing, the partition being positioned at a height at which the partition is in contact with a surface of the ink and the partition does not interfere with motion of the blades.

6. The tank according to claim 5, wherein the partition divides the internal space of the housing in a grid form.

7. An ink storage tank for an inkjet printer, the tank storing ink to supply the ink to an inkjet head equipped with a plurality of nozzles configured to eject the ink, the tank comprising:

an agitator mixing the ink in an ink storage space defined in a housing of the ink storage tank, wherein the agitator includes a rotary shaft horizontally installed in the ink storage space, one or more blades that protrude outward from the rotary shaft, and a rotation drive unit configured to rotate the rotary shaft, wherein a bottom surface of the ink storage space has a concavely curved shape corresponding to a trace of outer edges of the rotating blades, wherein the rotation drive unit is disposed outside the housing of the ink storage tank, wherein a rotational force of the rotation drive unit disposed outside the housing rotates the rotary shaft disposed inside the housing, the rotational force being caused by a magnetic force that arises between a first magnetic element that is connected to the rotary shaft and disposed inside the housing and a second magnetic element that is connected to the rotation drive unit and disposed outside the housing, wherein the first magnetic element includes four magnetic poles arranged in a manner that N poles and S poles alternated, and the second magnetic element includes four magnetic poles positioned to correspond to the four magnetic poles of the first magnetic element, respectively, and arranged in a manner that N poles and S poles alternate.

8. An ink storage tank for an inkjet printer, the tank storing ink to supply the ink to an inkjet head equipped with a plurality of nozzles configured to eject the ink, the tank comprising:

an agitator mixing the ink in an ink storage space defined in a housing of the ink storage tank;

wherein the agitator includes a rotary shaft horizontally installed in the ink storage space, one or more blades that protrude outward from the rotary shaft, and a rotation drive unit configured to rotate the rotary shaft, and wherein a bottom surface of the ink storage space has a concavely curved shape corresponding to a trace of outer edges of the rotating blades, wherein the tank further comprises:

a sensor installed at a supply pipe through which the ink is supplied to the inkjet head, the sensor being configured to measure an amount of nanorods dispersed in the ink; and a controller that controls a rotation speed of the agitator on the basis of a measurement result of the sensor.

* * * * *